US005083298A

United States Patent [19]

Citterio et al.

[11] Patent Number: 5,083,298

[45] Date of Patent: Jan. 21, 1992

[54] MONITORING APPARATUS

[75] Inventors: Giorgio Citterio, Horgen; Werner Hartmeier, Effretikon, both of Switzerland

[73] Assignee: Rieter Machine Works, Ltd., Winterthur, Switzerland

[21] Appl. No.: 590,310

[22] Filed: Sep. 28, 1990

[30] Foreign Application Priority Data

Sep. 29, 1989 [DE] Fed. Rep. of Germany ..... 3932665

[51] Int. Cl.[5] ..... G01S 15/00

[52] U.S. Cl. ..... 367/96; 367/13

[58] Field of Search ..... 367/96, 13, 909, 93; 73/1 DV

[56] References Cited

U.S. PATENT DOCUMENTS

| | | | |
|---|---|---|---|
| 3,220,005 | 11/1965 | Benoit | 342/458 |
| 3,851,168 | 11/1974 | Erbstein | 250/221 |
| 3,876,969 | 4/1975 | Price | 367/96 |
| 4,120,389 | 10/1978 | Erickson | 192/129 A |
| 4,706,227 | 11/1987 | DuVall et al. | 367/96 |

FOREIGN PATENT DOCUMENTS

| | | |
|---|---|---|
| 2310973 | 9/1973 | Fed. Rep. of Germany . |
| 2436755 | 3/1975 | Fed. Rep. of Germany . |
| 2541405 | 3/1977 | Fed. Rep. of Germany . |
| 2809001 | 11/1983 | Fed. Rep. of Germany . |
| 3833154 | 4/1989 | Fed. Rep. of Germany . |
| 3807383 | 9/1989 | Fed. Rep. of Germany . |
| 0127219 | 9/1976 | German Democratic Rep. . |
| 0592751 | 7/1977 | Switzerland . |

OTHER PUBLICATIONS

Biehi, Karl-Ernst, Contact-Free Distance Measurement, Elecktronic, vol. 32, No. 26/1983.

Ahrens, U.: Moglichkeiten and Grenzen des Einsatzes Van Luft—Ultraschallsensoren in Der Montage—und Handhabungstechnik. In: Roboter-Systeme, 1.203-210, 1985.

*Primary Examiner*—Daniel T. Pihulic

*Attorney, Agent, or Firm*—Kenyon & Kenyon

[57] ABSTRACT

A monitoring apparatus is described for the contact-free monitoring of a region adjacent to a service robot of a ring spinning machine. The apparatus includes an electro-acoustic converter for transmitting a sonic signal which is divided into a sonic measurement signal $S_{SM}$ and a sonic reference signal $S_{SR}$. An electronic control unit delivers a fault signal if no sonic signal has been received by the expiry of a reference transit time. If, on the other hand, a sonic measurement signal is received prior to the expiry of the reference transit time, the control unit delivers a recognition signal to indicate the presence of an object in the monitored region.

11 Claims, 2 Drawing Sheets

MONITORING APPARATUS

Figure 1:
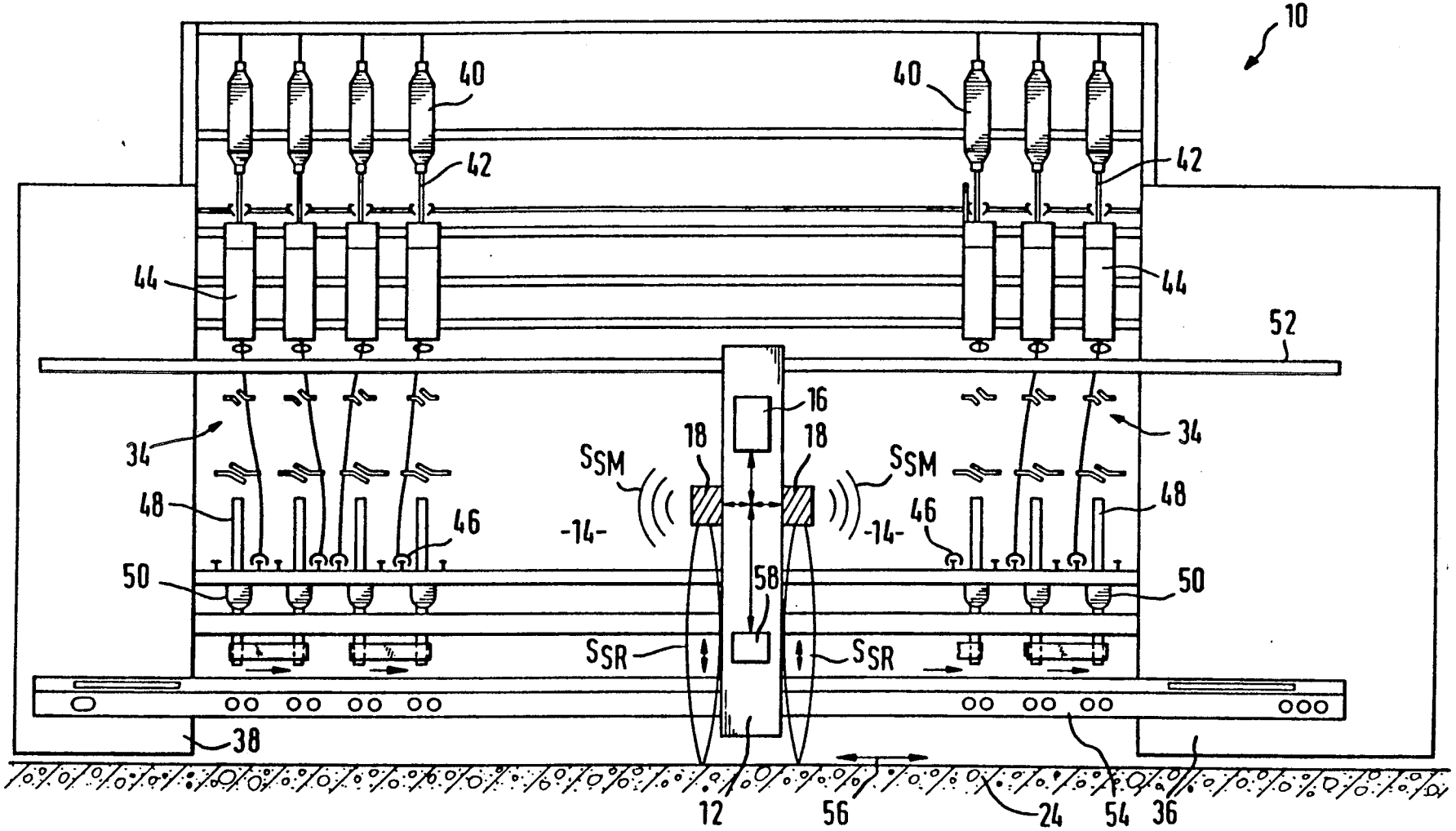

This invention relates to a monitoring apparatus. More particularly, this invention relates to an apparatus for the contact-free monitoring of a region adjoining a movable machine part.

In the context of automating processes, for example by means of travelling service robots, increasing significance is attributed to the protection of persons and protection against collision. It must be ensured that the respective operators are not endangered by the automatically controlled movable machine parts, robots, vehicles and the like. On the other hand, it must be ensured that travelling machine units, which can be controlled independently of one another, such as for example robots, do not collide.

There are many sensors which recognize articles in contact-free manner, such as for example capacitive, magnetic, electromagnetic and optical detectors. Capacitive, magnetic and electromagnetic sensors generally have the decisive disadvantage that the measurement result depends on the particular material of the object. Furthermore, their range is relatively small. In order to recognize the presence of specific target objects, acoustic sensors have already been used which meet the requirements placed on a measurement result which is as independent as possible with regard to the object material (see for example the special print "Contact-Free Distance Measurement" in the Journal "Electronik", Vol. 32, No. 26/1983, Franzis-verlag, Munich). The known acoustic monitoring systems have, however, the disadvantage that when defects occur, in particular in the area of the sensors, dangerous collisions can no longer be reliably precluded.

Accordingly, it is an object of the invention to provide for the contact-free monitoring of a region employing a monitoring apparatus of simple construction.

It is another object of the invention to not only ensure a reliable monitoring of a region but also to ensure against injury to objects within the monitored region at all times.

It is another object of the invention to protect against faults in a monitoring apparatus when monitoring a region in front of a moving machine part.

Briefly, the invention provides a monitoring apparatus for mounting on a movable machine part which includes at least one electro-acoustic converter for transmitting a sonic signal into a monitor region and for receiving a reflected sonic signal from an object in the monitored region.

In accordance with the invention, the monitoring apparatus has means for dividing the transmitted sonic signal into a sonic measurement signal directed into the monitored region and a sonic reference signal for direction onto a reference reflector having a predetermined distance from the converter. The sonic reference signal has a reference transit time dependent on the distance between the reflector and the converter and, particularly, the distance covered by the reference signal in being transmitted from the converter and reflected back by the reflector to the converter.

An electronic control unit is also provided in the monitoring apparatus and is connected to the converter for delivering a fault signal in response to a failure of the converter to receive a reflective sonic signal within the reference transit time. On the other hand, the control unit delivers a recognition signal representative of an object in the monitored region in response to reception of a reflected measurement signal within the reference transit time.

As result of this construction, faults and defects are immediately and reliably recognized, in particular in the area of the converters. Thus, if necessary, a timely and appropriate intervention can be made in the drive control of the relevant movable machine part, for example of a service robot which is capable of travelling in a path along a spinning machine. An intervention of this kind can take place automatically on the occurrence of the recognition signal delivered from the electronic control unit.

If the monitoring apparatus operates in fault free manner, and if no operator or no disturbing object is present in the monitoring region, then a sonic signal is received following transmission of the transmitted sonic signal at a time which corresponds to the reference transit time, with this sonic signal being the reference signal reflected at the reference reflector. In this case, the monitoring apparatus remains passive, since neither an article in the monitoring region or a fault of the apparatus has been recognized. There is in this case, no reason to intervene in the drive control, for example of the service robot.

If, in contrast, a sonic signal is received after the transmission of the respective transmitted sonic signal and before expiry of the reference transit time, then the electronic control unit of the monitoring apparatus recognizes that either a disturbing article is present in the endangered monitored region or an operator is present in this monitored region.

If finally the sonic signal which is received first appears after transmission or initiation of the transmitted sound signal, and after expiry of the predeterminable reference transit time, then the electronic control unit recognizes the presence of a fault or defect, in particular in the sensors or sensory analysis of the apparatus. Possible sources of error are for example that no sonic pulse was transmitted as result of a defective transmitter, that despite a transmitted sonic pulse no reflected reference signal was received, that the received signals are too weak, in particular as result of contamination of the converter, or that a new adjustment of the sensor arrangement is necessary.

The monitoring apparatus for persons and against collision can for example be used on machines, such as in particular robots which serve spinning machines, moved machines or machine parts, vehicles and transport systems, in particular in spinning mills. A preferred field of application are the service robots of spinning machines. The monitoring apparatus ensures, in particular, a reliable collision protection when using two or more service robots. In the latter case, each of the service robots is expediently provided with a monitoring apparatus.

An ultrasonic converter is preferably provided as the electro-acoustical converter, so that the apparatus is in particular insensitive to the normally occurring industrial noise.

The electro-acoustical converter preferably simultaneously forms a sound transmitter and a sound receiver. Through an appropriate layout of the electronic control unit the electro-acoustical converter is in this case alternatingly operated as a transmitter and as a receiver. The construction of the overall arrangement can in this case be kept particularly simple.

The means for dividing up the transmitted sound signal include at least one passive sound deflecting element, which can for example be a reflector and which is so arranged that a part of the transmitted sound component is allowed through to the monitoring region while the other sound component is deflected to the reference reflector.

In accordance with a particularly preferred embodiment provision is made for the spacing between the electroacoustical converter and the reference reflector to be adjustable. For this purpose, the reference reflector is preferably adjustable. Since the distance of an article present in the monitoring region which can just be measured depends on the distance of the reference reflector from the converter, the just measurable distance of the article is also simultaneously variable with this distance. The ground or surface on which the relevant machine is erected can for example serve as the reference reflector. A reference reflector can also expediently be provided on a fixed part of the relevant machine, for example on a spinning machine along which a service robot moves to and fro. With this arrangement, attention should in any event be paid to the fact that the distance between the electro-acoustical converter and the reference reflector remains the same independently of the respective position of the movable machine part or service robot.

In accordance with another expedient embodiment, the reference reflector is arranged on the movable machine part, for example on a movable service robot of a spinning machine.

With a machine part which is movable in at least two different directions, at least one electro-acoustic converter is preferably provided for each direction. With a movement of the movable machine part or service robot in one particular direction of travel only the electro-acoustic converter associated with this direction is controllable by the electronic control unit. In this way, the signals which are received are always unambiguous, and that in any event that region is monitored which is endangered as a result of the machine part which is being introduced into this region.

In accordance with a practical preferred embodiment provision is made that the drive of the movable machine part, for example of the relevant service robot, can be controlled on the occurrence of the recognition signal, in particular by the electronic control unit, in such a way that an interruption or reversal of the movement of the movable machine part takes place, at least for a period of time. The particular danger is then automatically alleviated without any action on the part of a particular operator. For example, in the case of a service robot movable along the spinning stations of a spinning machine, the direction of movement can be reversed on the occurrence of a danger of collision. A renewed reversal of the direction of movement can then take place at specific fixedly preset positions along the track. On the other hand, the movement of the service robot may be interrupted with the robot again moving in the same direction as soon as the monitored region is free.

The appearance of the fault signal can preferably be signaled by the electronic control unit in a manner recognizable to the particular operator, e.g. as an acoustic signal or a visual signal. Provision is also expediently made to automatically stop the movable machine part or the service robot for safety's sake if a fault is recognized.

Figure 2:
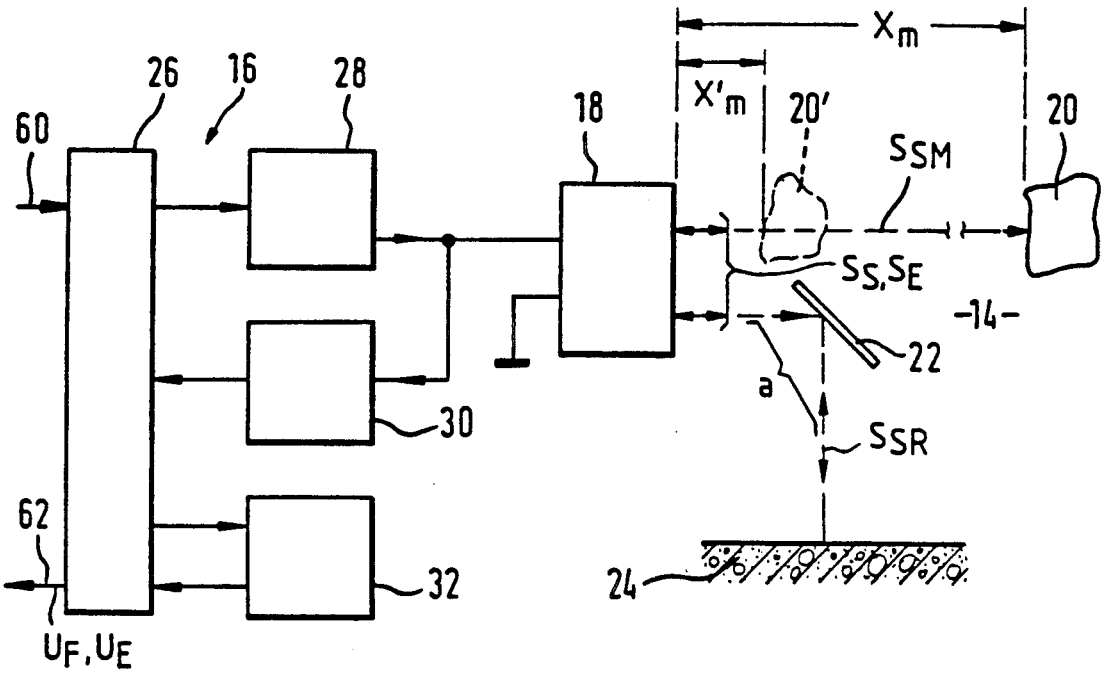
Figure 3:
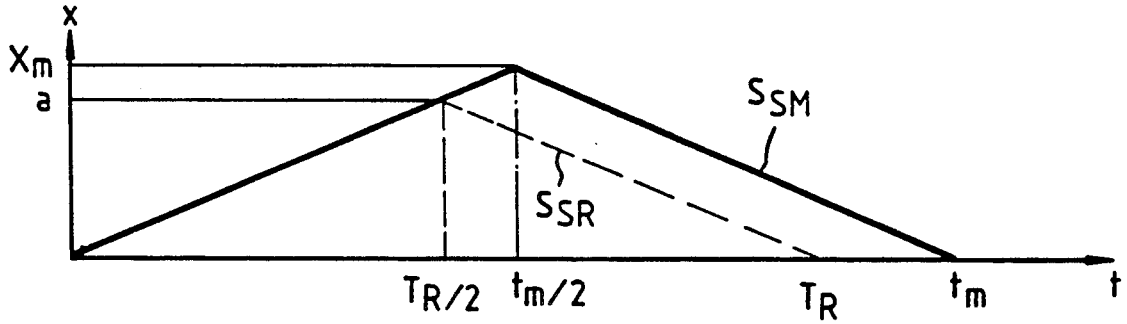
Figure 4:
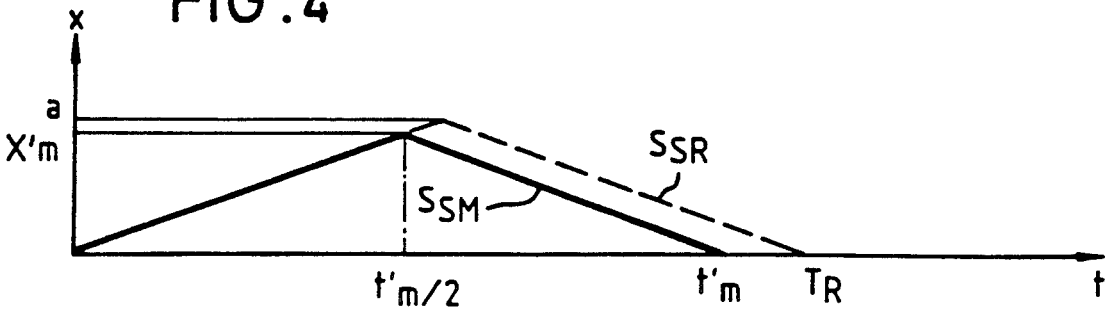

These and other objects and advantages of the invention will become more apparent from the following detailed description taken in conjunction with the accompanying drawings wherein:

FIG. 1 illustrates a schematic side view of a ring spinning machine employing a monitoring apparatus on each side of a service robot movable along the spinning machine in accordance with the invention;

FIG. 2 schematically illustrates a monitoring apparatus constructed in accordance with the invention;

FIG. 3 illustrates a transit time diagram of the measurement signal with an object outside the monitoring region; and FIG. 4 illustrates a transit time diagram of the measurement signal with an object within the monitored region.

Referring to FIG. 1, the ring spinning machine 10 has a plurality of spinning stations 34 which are arranged between a head part 36 and a foot part 38 of the spinning machine. The same number of spinning stations is also provided on the opposite side of the machine, which cannot be seen.

At each of the spinning stations 34, a roving 42 coming from a roving spool 40 is drafted in a drafting mechanism 44 and the drafted yarn is wound by means of a ring traveller 46 onto a spinning sleeve 48 in order to form a yarn package 50.

A service robot 12 is associated with the ring spinning machine 10 and is guided along an upper guide rail 52 and also a lower guide and positioning rail 54. This service robot 12 which represents a movable machine part can travel in a path in the direction indicated by the double arrow 56 along the spinning stations 34. The service robot 12 can have an automatic piecing and winding-on unit (not shown) and also further units which are not shown for serving the respective spinning stations.

The service robot 12 which is movable along the guide rails 52, 54 is equipped with a monitoring for the contact-free monitoring of the regions 14 adjacent the two sides of the robot. This monitoring apparatus has, in each case, one electro-acoustic converter 18 on each of the two opposite sides of the service robot 12 for the transmission of a transmitted sound signal $S_S$ and also for the reception of a received sound signal $S_E$ (see also FIG. 2). These two electro-acoustic converters are connected to an electronic control unit 16. This electronic control unit 16 can be a part of the control unit associated with the service robot 12, and can in particular serve as a drive control of this robot.

As can be seen from FIG. 2, a means is provided for each converter 18 for dividing the transmitted sonic signal into a sonic measurement signal directed into the monitored region 14 and a sonic reference signal. For example, each means is in the form of a passive sonic deflecting element 22 associated with each electro-acoustic converter 18 and, in the present case, is a simple planar reflector which is pivoted through 45° relative to the vertical, so that the horizontally impinging signal is reflected perpendicularly downwardly to the floor carrying the ring spinning machine and this floor serves as a reference reflector 24, as will be explained further below in detail.

The passive sonic deflecting element 22 serves to split up the sonic signal $S_S$ transmitted by the relevant electro-acoustic converter 18 into a sonic measurement signal $S_{SM}$ directed into the monitored region 14 and a sonic reference signal $S_{SR}$. A corresponding combining accordingly also takes place for the received sound signal $S_E$ received by the electro-acoustic converter 18.

Thus, the sonic measurement sound signal $S_{SM}$ which serves for the monitoring of the monitored region 14 extends from the electro-acoustic converter 18 into the monitored region 14 and, with an article 20 or 20' or a person present in this monitored region 14, back to the converter 18 as a result of the reflection which takes place.

In contrast, the component of the transmitted signal coming from the converter 18 which forms the reference signal $S_{SR}$ is reflected at the passive sonic deflective element 22 downwardly to the floor or to the reference reflector 24. Whereupon, this reference signal $S_{SR}$ passes in the reverse direction via the passive sonic deflection element 22 back to the converter 18 again to form a part of the received sonic signal $S_E$ received by the converter 18.

The floor or the reference reflector 24 has a predetermined spacing a from the electro-acoustic converter 18 when measured along the single beam path of the sonic reference signal $S_{SR}$.

The spacing $X_m$ of the article 20 present in the monitored region 14 is larger than the above defined distance a of the ground or of the reference reflector 24 from the converter 18. In contrast, the other illustrated article 20' has a distance $X'_m$ from the converter 18 which is smaller than the distance a.

In accordance with FIG. 2, the electronic control unit 16 includes a microprocessor 26 with an input 60 which is, for example, connected to an non-illustrated input unit, and also an output 62 by which the microprocessor 26 delivers a fault signal $U_F$ when the monitoring apparatus is faulty, and a recognition signal $U_E$ on detecting an article 20' or a person present in the monitored region 14.

Whereas a signal transmitter 58 for example (FIG. 1) can be energized by means of the fault signal $U_F$, a respective recognition signal $U_E$ can be used for a corresponding intervention in the drive control of the service robot 12.

In the present embodiment, the electro-acoustic converter 18 which delivers the ultrasonic pulse simultaneously forms a sound transmitter and a sound receiver. In this arrangement, the converter 18 is alternatively activated by the electronic control unit 16 as a transmitter and receiver respectively. For this purpose, the electronic control unit 16 includes an electronic transmitter circuit 28 connected to the microprocessor 26 and also an electronic receiver circuit 30 which is likewise connected to the microprocessor 26 and which can for example have a receiving amplifier. Furthermore, a counter 32 is associated with the microprocessor 26 of the electronic control unit 16 by which in particular the respective transit times of the received sound signals can be determined.

The two electro-acoustic converters 18 provided on oppositely disposed sides of the service robot 12 are activated individually in dependence on the respective direction of travel of the robot 12. An activation of the respective electro-acoustic converter 18 which delivers ultrasonic pulses into the monitored region adjoining the service robot 12 and into which the service robot is moving takes place through the electronic control unit 16 of the monitoring apparatus, or of the service robot. When this is done the other converter is in each case set out of operation.

A transit time diagram for the ultrasonic pulses such as results for an article 20 present in the monitored region 14 is shown in FIG. 3 and further removed from the electro-acoustic converter 18 than the above defined distance a of the floor or reference reflector 24 from this converter 18.

In contrast, a transit time diagram for the ultrasonic pulses is shown in FIG. 4 showing the situation with an article 20' present in the monitored region 14 with the article 20' being closer to the electro-acoustic converter than would correspond to the distance a defined above. Whereas time is in each case recorded along the abscissa, the ordinate in each case specifies the distance to the object. Accordingly, it can be seen that the respective ultrasonic pulse runs from the electro-acoustic converter 18 to the target object, i.e. to the article 20 or 20', is reflected there at the time $t_m/2$ and $t'_m/2$ respectively and reaches the converter 18 again at the time $t_m$ and $t'_{ms}$ respectively (continuous lines). This transit time $t_m$ and $t'_m$ respectively of the sonic measurement signal $S_{SM}$ (see FIG. 2) is directly proportional to the distance of the object $X_m$ and $X'_m$. The following relationship applies:

$$X_m = \tfrac{1}{2}\, c\, t_m \text{ and}$$

$$X'_m = \tfrac{1}{2}\, c\, t'_m.$$

The ultrasonic pulse of the sonic reference sound signal $S_{SR}$ runs from the electro-acoustic converter 18 to the passive sound deflecting element 22, is reflected from there to the ground or to the reference reflector 24 and is reflected there at the time $T_R/2$ back to the passive sound deflection element 22 and, from there, again reflected to the converter 18 to arrive after a reference transit time $T_R$.

The monitoring apparatus of the invention functions as follows:

If the monitoring apparatus operates fault free, and if an article 20 is present in the monitored region 14 relatively far from the electro-acoustical converter 18 then the sonic reference signal $S_{SR}$ which is first reflected at the floor or at the reference reflector 24 is received by the converter 18 (see FIGS. 2 and 3) at the time Tr. The sonic measurement signal $S_{SM}$ reflected at the article 20 which is further removed occurs at a later time $t_m$. Since a signal was received up to the expiry of the reference transit time $T_R$, namely the reference signal $S_{SR}$, the electronic control unit 16 recognizes that the monitoring apparatus is operating in fault free manner. Since the measurement signal $S_{SM}$ reflected at the article 20 is received at a later point in time $t_m > T_R$ this signal is no longer taken into account by the electronic control unit 16 so that a recognition signal $U_E$ is not transmitted. Also, the transmission of a fault signal $U_F$ does not take place because the reference signal $S_{SR}$ has occurred at the predetermined time, i.e. after at the expiration of the reference transit time $T_R$. In this case, illustrated in FIG. 3, the distance $X_m$ is larger than the distance a.

If, in contrast, the article 20' lies closer to the electro-acoustic converter 18, i.e. if the distance a is larger than the distance $X'_m$ then the ultrasonic pulse behaves timewise as shown in FIG. 4. Accordingly, the measurement signal $S_{SM}$ reflected at the article 20' is received at a time $t'_m$ before the expiry of the predetermined reference transit time $T_R$. Since $t'_m < T_R$ the electronic control unit 16 delivers a recognition signal $U_E$ which is representative for the presence of the article 20' or of a person at the same distance in the monitored region 14.

If the article 20 or 20' is missing in the monitored region 14 when the monitoring device is operating in a fault free manner then the same conditions prevail as in the case of an article 20 which is located further away from the converter 18 and thus not detected (see FIG. 3).

With a fault or defect of the sensor or sensor system, the reference signal $S_{SR}$ is first received after the expiry of the reference transit time $T_R$, which may for example be permanently stored, or is not received at all. This is evaluated by the electronic control unit 16 as a fault in the monitoring apparatus. As a consequence, the electronic control unit 16 delivers the error signal $U_F$ by which the signal transmitter 58 in particular may be activated (see FIG. 1). At the same time, the service robot 12 is taken out of operation for safety's sake.

If in contrast the recognition signal $U_E$ occurs which is representative for the presence of an article or a person in the monitored region, then the service robot 12 need not necessarily be set out of operation. On the contrary, the drive of the robot 12 can be expediently activated in the sense of reversing the direction of travel.

What is claimed is:

1. A monitoring apparatus for mounting on a movable machine part, said apparatus comprising at least one electro-acoustic converter for transmitting a sonic signal into a monitored region and for receiving a reflected sonic signal from an object in said monitored region;

means for dividing said transmitted sonic signal into a sonic measurement signal directed into said monitored region and a sonic reference signal for direction onto a reference reflector having a predetermined distance from said convertor, said reference signal having a reference transit time dependent on said distance, said means being disposed to direct a reflected sonic reference signal from the reflector to said converter and a reflected measurement signal from an object to said converter; and an electronic control unit connected to said converter for delivering a fault signal in response to a failure of said converter to receive a reflected sonic signal within said reference transit time and for delivering a recognition signal representative of an object in said monitored region in response to reception of a reflected measurement signal before expiration of said reference transmit time.

2. A monitoring apparatus as set forth in claim 1 wherein said convertor is an ultrasonic converter.

3. A monitoring apparatus as set forth in claim 1 wherein said means is a passive sonic deflecting element.

4. A monitoring apparatus as set forth in claim 1 which further comprises an adjustably mounted reference reflector for receiving said reference signal from said means.

5. A monitoring apparatus as set forth in claim 1 wherein said fault signal is one of an acoustic signal and a visual signal.

6. In combination a spinning machine;

a service robot movable in a path along said machine;

at least one electro-acoustic converter mounted on said robot for transmitting a sonic signal into a monitored region in said path and for receiving a reflected sonic signal from an object in said monitored region;

a reference reflector disposed at a predetermined distance from said converter; means for dividing said transmitted sonic signal into a sonic measurement signal directed into said monitored region and a sonic reference signal for direction onto said reflector said reference signal having a reference transit time dependent on said distance, said means being disposed to direct a reflected sonic reference signal from the reflector to said converter and a reflected measurement signal from an object to said converter; and an electronic control unit connected to said converter for delivering a fault signal in response to a failure of said converter to receive a reflected sonic signal within said reference transit time and for delivering a recognition signal representative of an object in said monitored region in response to reception of a reflected measurement signal before expiration of said reference transit time.

7. The combination as set forth in claim 6 wherein said reflector is disposed on said machine.

8. The combination as set forth in claim 6 wherein said reflector is a floor supporting said machine.

9. The combination as set forth in claim 6 wherein said reflector is mounted on said robot.

10. The combination as set forth in claim 6 wherein said robot is movable in opposite directions in said path and has a pair of said convertors, each converter being disposed to transmit a sonic signal in an opposite direction of said path from the other converter.

11. A monitoring apparatus as set forth in claim 1 wherein said sonic measurement signal is directed through a beam path into said monitored region and which further comprises a reference reflector outside said beam path for receiving said sonic reference signal.

* * * * *